US009044955B2

(12) United States Patent
Hirai et al.

(10) Patent No.: US 9,044,955 B2
(45) Date of Patent: Jun. 2, 2015

(54) LIQUID JETTING APPARATUS

(71) Applicant: Brother Kogyo Kabushiki Kaisha, Nagoya-shi, Aichi-Ken (JP)

(72) Inventors: Keita Hirai, Nagoya (JP); Shohei Koide, Nagoya (JP); Taisuke Mizuno, Nagoya (JP); Hiromitsu Mizutani, Ichinomiya (JP); Yusuke Suzuki, Anjo (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 14/456,231

(22) Filed: Aug. 11, 2014

(65) Prior Publication Data

US 2015/0049143 A1 Feb. 19, 2015

(30) Foreign Application Priority Data

Aug. 13, 2013 (JP) ..... 2013-168206

(51) Int. Cl.
*B41J 2/05* (2006.01)
*B41J 2/175* (2006.01)

(52) U.S. Cl.
CPC ..... *B41J 2/175* (2013.01)

(58) Field of Classification Search
USPC ..... 347/65, 66, 67, 68
See application file for complete search history.

(56) References Cited

U.S. PATENT DOCUMENTS

| | | | | |
|---|---|---|---|---|
| 5,489,930 | A * | 2/1996 | Anderson | 347/71 |
| 6,584,687 | B1 * | 7/2003 | Yamamoto et al. | 29/890.1 |
| 7,497,557 | B2 * | 3/2009 | Sugahara | 347/68 |
| 7,641,318 | B2 * | 1/2010 | Mataki | 347/68 |
| 7,806,511 | B2 * | 10/2010 | Ishikawa | 347/40 |
| 2002/0048477 | A1 | 4/2002 | Udagawa et al. | |
| 2006/0244797 | A1 | 11/2006 | Tajima | |
| 2009/0189951 | A1 | 7/2009 | Tajima | |
| 2011/0242237 | A1 | 10/2011 | Uezawa | |

FOREIGN PATENT DOCUMENTS

| | | |
|---|---|---|
| JP | 2002-086730 | 3/2002 |
| JP | 2006-327176 | 12/2006 |
| JP | 2011-213030 | 10/2011 |

* cited by examiner

*Primary Examiner* — Anh T. N. Vo
(74) *Attorney, Agent, or Firm* — Frommer Lawrence & Haug LLP

(57) ABSTRACT

A liquid jetting apparatus includes: a liquid jetting section having a liquid jetting surface in which a plurality of nozzles are formed, and configured to jet a liquid from the plurality of nozzles; and a liquid supply section provided on the liquid jetting section on a side opposite to the liquid jetting surface with respect to a direction intersecting the liquid jetting surface, and configured to supply the liquid to the liquid jetting section. The liquid jetting section includes: two nozzle groups arranged apart in a predetermined scanning direction, each nozzle group including a plurality of nozzles aligned in a nozzle arrangement direction which intersects the scanning direction; and two common liquid chambers arranged apart in the scanning direction, each common liquid chamber extending in the nozzle arrangement direction and communicating with one of the two nozzle groups.

15 Claims, 12 Drawing Sheets

LIQUID JETTING APPARATUS

CROSS REFERENCE TO RELATED APPLICATION

The present application claims priority from Japanese Patent Application No. 2013-168206, filed on Aug. 13, 2013, the disclosure of which is incorporated herein by reference in its entirety.

BACKGROUND OF THE INVENTION

1. Field of the Invention

The present invention relates to a liquid jetting apparatus.

2. Description of the Related Art

As a liquid jetting apparatus, an ink-jet head which jets an ink from a plurality of nozzles while moving in a predetermined scanning direction has been known. This ink-jet head includes an ink jetting member and an ink supplying member. The ink jetting member has nozzle rows of three types jetting inks of three colors respectively. Three ink tanks, in which inks of three colors to be supplied to the nozzle rows of three types are stored respectively, are installed to the ink supplying member. In other words, the abovementioned ink-jet head is a head of a so-called on-carriage type with the ink tanks mounted thereon.

More elaborately, the ink jetting member includes two first nozzle rows which jet an ink supplied from a first ink tank, two second nozzle rows which jet an ink supplied from a second ink tank, and one third nozzle row which jets an ink supplied from a third ink tank. Out of these five nozzle rows, the third nozzle row is arranged at a center. The two second nozzle rows are arranged on left side and right side of the third nozzle row respectively. Furthermore, the two first nozzle rows are arranged on left side and right side of the second nozzle rows and the third nozzle row. Besides, the ink jetting member includes five ink supply ports in the form of elongate holes, which are arranged side by side in the scanning direction of the ink-jet head, and which communicate with the five nozzle rows respectively.

The ink supplying member is a member which has a significantly larger planar size (a size on a flat plane parallel to an ink jetting surface of the head) as compared with the ink jetting member. The ink supplying member has three ink infusion holes to be connected to the ink tanks of three types respectively. A first ink infusion hole corresponding to the two first nozzle rows is arranged on one side in a nozzle arrangement direction (longitudinal direction of the ink supply ports) with respect to the ink jetting member. A second ink infusion hole corresponding to the two second nozzle rows is arranged on the other side in the nozzle arrangement direction with respect to the ink jetting member. A third ink infusion hole corresponding to the one third nozzle row is arranged at a position, of the ink jetting member, overlapping with the ink supply port communicating with the third nozzle row.

Furthermore, the ink supplying member has a distribution chamber, for each of the first ink infusion hole and the second ink infusion hole, for distributing the ink to the two corresponding ink supply ports. A first distribution chamber is arranged on the one side in the nozzle arrangement direction with respect to the ink jetting chamber, and the ink infused through the first ink infusion hole is distributed by the first distribution chamber to the two ink supply ports corresponding to the two first nozzle rows respectively. Similarly, a second distribution chamber is arranged on the other side in the nozzle arrangement direction, and the ink infused through the second ink infusion hole is distributed by the second distribution chamber to the two ink supply ports corresponding to the two second nozzle rows respectively.

SUMMARY OF THE INVENTION

In the abovementioned ink-jet head, the first ink infusion hole and the second ink infusion hole, and the distribution chambers for distributing the inks to the two nozzle rows (two ink supply ports) through each of the first and second ink infusion holes are arranged outside the ink jetting member. Therefore, a planar size of the ink supplying member having the ink infusion holes and the distribution chambers becomes larger with respect to the ink jetting member. Moreover, as the types of the inks to be jetted increase, the types of nozzle rows also increase, and it is necessary to provide distribution chambers corresponding to the nozzle rows around the ink jetting member. Therefore, a planar size of the ink supplying member becomes even larger.

Moreover, in an arrangement of the abovementioned ink-jet head, the ink infusion hole and the distribution chamber are arranged on only one end side in the nozzle arrangement direction for one nozzle row (ink supply port). In other words, the ink is supplied to one nozzle row only from one end side in the nozzle arrangement direction. However, in a case in which the number of nozzles in one row is large and the ink is jetted from the plurality of nozzles simultaneously, there is a possibility that the ink supply to the nozzle row is not sufficient. To prevent such shortage of ink supply, an arrangement, in which the ink is supplied to one nozzle row from both end sides in the nozzle arrangement direction, is preferable. However, to adopt such an arrangement, it is necessary to provide an ink infusion hole and a distribution chamber on each of two end sides in the nozzle arrangement direction, for two nozzle rows for jetting the ink of same color, and accordingly, the planar size of the ink supply section becomes further larger.

Moreover, in order to make the nozzle rows of the ink-jet head long, it can also be considered to arrange two ink jetting members having the same structure side by side. In this case, it is necessary to arrange the ink supplying member and the distribution chamber corresponding to each ink jetting member, and the planar size of the ink supplying member becomes large as expected.

An object of the present invention is to suppress a size of a liquid jetting apparatus, in a plane parallel to a liquid jetting surface, from becoming large, wherein in the liquid jetting apparatus, it is necessary to supply a liquid flowed in through one liquid inflow portion to two nozzle groups (the nozzle row in the abovementioned example corresponds to the nozzle group) for jetting a same type of liquid separately by distributing the liquid.

According to a first aspect of the present invention, there is provided a liquid jetting apparatus including: a liquid jetting section having a liquid jetting surface in which a plurality of nozzles are formed, and configured to jet a liquid from the plurality of nozzles; and a liquid supply section provided on the liquid jetting section on a side opposite to the liquid jetting surface with respect to a direction which intersects the liquid jetting surface, and configured to supply the liquid to the liquid jetting section, wherein the liquid jetting section includes: two nozzle groups arranged apart from each other in a predetermined scanning direction, each nozzle group including a plurality of nozzles aligned in a nozzle arrangement direction which intersects the scanning direction; and two common liquid chambers arranged apart from each other in the scanning direction, each common liquid chamber extending in the nozzle arrangement direction and communicating with one of the two nozzle groups, wherein the liquid supply section includes: a liquid inflow portion into which the liquid flows; and a supply channel configured to connect the liquid inflow portion and the two common liquid chambers, wherein the supply channel includes: an upstream-side channel connected to the liquid inflow portion at a first connecting portion; and two downstream-side channels arranged on a side of the liquid jetting section with respect to the upstream-side channel in the direction which intersects the liquid jetting surface, and configured to connect the upstream-side channel with the two common liquid chambers respectively, wherein at least one of two second connecting portions, which are configured to connect the upstream-side channel with the two downstream-side channels respectively, is arranged apart from the first connecting portion in the scanning direction, wherein each of the two downstream-side channels is connected to one of the two common liquid chambers at both end portions thereof in the nozzle arrangement direction, and wherein when viewed from the direction which intersects the liquid jetting surface, each of the two downstream-side channels overlaps with one of the two common liquid chambers.

The liquid jetting apparatus according to the first aspect of the present invention includes the liquid jetting section, and the liquid supply section which is provided on the liquid jetting section on the side opposite to the liquid jetting surface in the direction which intersects the liquid jetting surface. The liquid jetting section has two nozzle groups arranged apart from each other in the scanning direction, and two common liquid chambers communicating with the two nozzle groups respectively. The liquid supply section has the supply channel that distributes and supplies the liquid flowed in from the liquid inflow portion to the two common liquid chambers.

The supply channel includes the upstream-side channel that is connected to the liquid inflow portion, and the two downstream-side channels that connect the upstream-side channel and the two common liquid chambers respectively. The upstream-side channel and the two downstream-side channels are not arranged in the same plane parallel to the liquid jetting surface, but are arranged in the direction intersecting the liquid jetting surface, and form a stereoscopic channel structure. In the upstream-side channel, the first connecting portion to be connected to the liquid inflow portion and at least one of the second connecting portions to be connected to the downstream-side channels are arranged apart from each other in the scanning direction. Consequently, the liquid that has flowed into the upstream-side channel through the first connecting portion is distributed in the scanning direction by the upstream-side channel, and is supplied to the two common liquid chambers through the two second connecting portions respectively. Further, each of the downstream-side channels is connected to one of the two common liquid chambers extending in the nozzle arrangement direction at both end portions thereof in the nozzle arrangement direction. Accordingly, the liquid that has flowed into each of the downstream-side channels is further distributed in the nozzle arrangement direction by the downstream-side channels, and is supplied to corresponding common liquid chamber at connecting points located at both end portions thereof in the nozzle arrangement direction.

According to a second aspect of the present invention, there is provided a liquid jetting apparatus including: a liquid jetting section having a liquid jetting surface in which a plurality of nozzles are formed, and configured to jet a liquid from the plurality of nozzles; and a liquid supply section provided on the liquid jetting section on a side opposite to the liquid jetting surface with respect to a direction which intersects the liquid jetting surface, and configured to supply the liquid to the liquid jetting section, wherein the liquid jetting section includes: two nozzle groups arranged apart from each other in a predetermined scanning direction, each nozzle group including a plurality of nozzles aligned in a nozzle arrangement direction which intersects the scanning direction; and two common liquid chambers arranged apart from each other in the scanning direction, each common liquid chamber extending in the nozzle arrangement direction and communicating with one of the two nozzle groups, wherein the liquid supply section includes: a liquid inflow portion into which the liquid flows; and a supply channel configured to connect the liquid inflow portion and the two common liquid chambers, and wherein the supply channel is connected to the two common liquid chambers at two connecting portions, respectively.

In this manner, in the present invention, the supply channels having a stereoscopic branched-channel structure is formed in the liquid supply section provided on the liquid jetting section on the side opposite to the liquid jetting surface. Accordingly, the structure of the supply channels in the liquid supply section becomes compact, and small-sizing of the liquid supply section becomes possible. Consequently, the planar size of the liquid jetting apparatus is suppressed from being large due to channels which are provided to distribute the liquid to the two nozzle groups.

DETAILED DESCRIPTION OF THE PREFERRED EMBODIMENTS

An embodiment of the present invention will be described below while referring to the accompanying diagrams.

<Schematic Structure of Printer>

Figure 1:
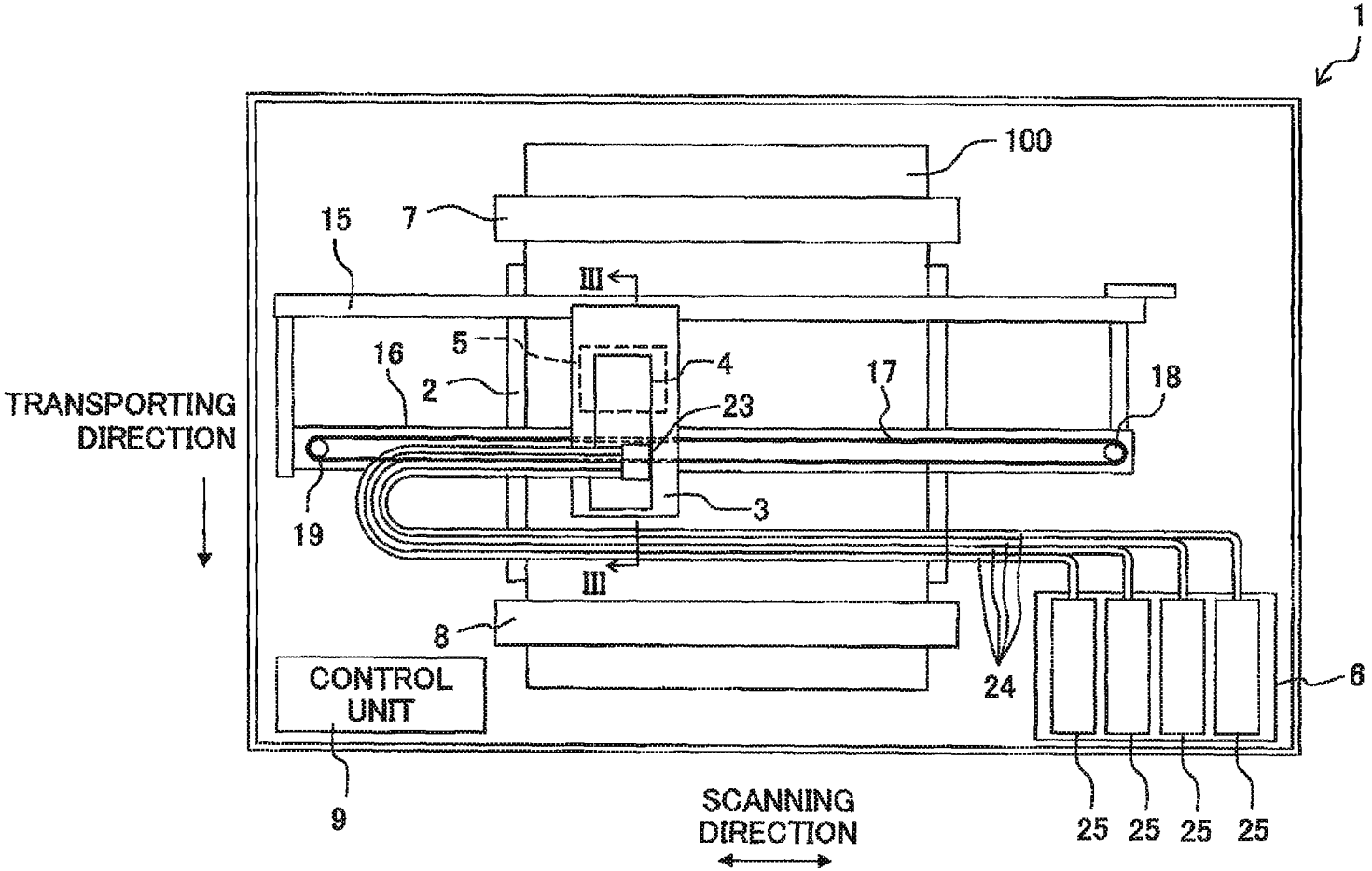
FIG. 1 is a schematic structural view of a printer according to an embodiment of the present invention.

As shown in FIG. 1, a printer 1 includes a platen 2, a carriage 3, a sub tank 4, an ink-jet head 5, a holder 6, a paper feeding roller 7, a paper discharge roller 8, and a control unit 9. In the following description, a frontward side of a paper surface of FIG. 1 is defined as an upward, a rearward side of the paper surface of FIG. 1 is defined as a downward, and the description is made by using terms for directions "upward" and "downward".

A recording paper 100 which is a recording medium is placed on an upper surface of the platen 2. Moreover, two guide rails 15 and 16 extending in parallel in a leftward-rightward direction (hereinafter, called as "scanning direction") in FIG. 1 are provided above the platen 2.

The carriage 3 is installed on two guide rails 15 and 16, and is movable in the scanning direction along the two guide rails 15 and 16 in an area facing the platen 2. Moreover, a drive belt 17 is attached to the carriage 3. The drive belt 17 is an endless belt put around two pulleys 18 and 19. The pulley 18 is linked to a carriage drive motor 20 (refer to FIG. 2). The drive belt 17 runs by the pulley 18 being driven to be rotated by the carriage drive motor 20, and accordingly, the carriage 3 reciprocates in the scanning direction.

Both the sub tank 4 and the ink-jet head 5 are mounted on the carriage 3. The sub tank 4 includes a main-body portion 21 in the form of a plate extending along a horizontal plane, and a connecting portion 22 extending vertically in a downward direction from an end portion, of the main-body portion 21, on an upstream side of a transporting direction.

Figure 3:
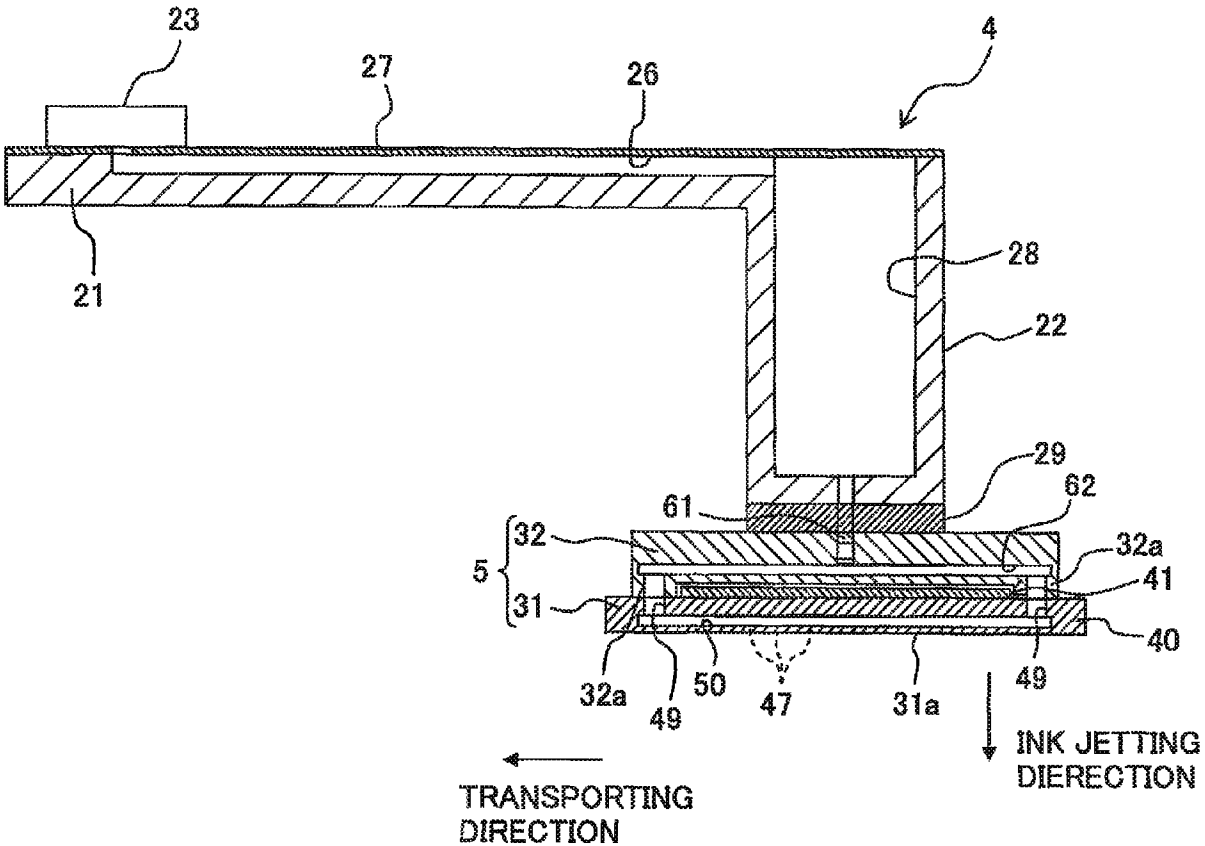
FIG. 3 is a vertical cross-sectional view along a line III-III of an ink-jet head and a sub tank in FIG. 1.

As shown in FIG. 1 and FIG. 3, a tube joint 23 is provided on an upper surface of the main-body portion 21, and four ink supply tubes 24 connected to the holder 6 are connected to the tube joint 23. Four ink cartridges 25 (liquid storage containers of the present invention) storing inks of four colors (black, yellow, cyan, and magenta) respectively, are replaceably installed on the holder 6. Inks in the four ink cartridges 25 of the holder 6 are supplied to the sub tanks 4 via the four ink supply tubes 24, respectively.

A damper chamber 26 is formed in the main-body portion 21. Although only one damper chamber 26 is shown in FIG. 3, practically, four damper chambers 26 are provided to the main-body portion 21. The inks of four colors supplied by the four ink supply tubes 24 connected to the tube joint 23 are infused into these four damper chambers 26, respectively. Moreover, the four damper chambers 26 are covered by a synthetic resin film 27. Four connecting channels 28 arranged in the scanning direction (direction perpendicular to paper surface in FIG. 3) and each extending in a vertical direction are formed in the connecting portion 22. The four connecting channels 28 communicate with the four damper chambers 26, respectively.

The ink-jet head 5 (liquid jetting apparatus of the present invention) is connected to a lower end of the communicating portion 22 of the sub tank 4 via a connecting member 29. The ink-jet head 5 includes an ink jetting section 31 and an ink supply section 32. Channels (such as manifold 50) in the ink supply section 32 communicate with four communicating channels 28 of the sub tank 4. An ink jetting surface 31*a* in which a plurality of nozzles 47 are formed is provided to a lower surface of the ink jetting section 31. The ink jetting section 31 jets the inks of four colors supplied from the sub tanks 4 via the ink supply section 32, from the plurality of nozzles 47. An arrangement of the ink-jet head 5 will be described later.

Figure 2:
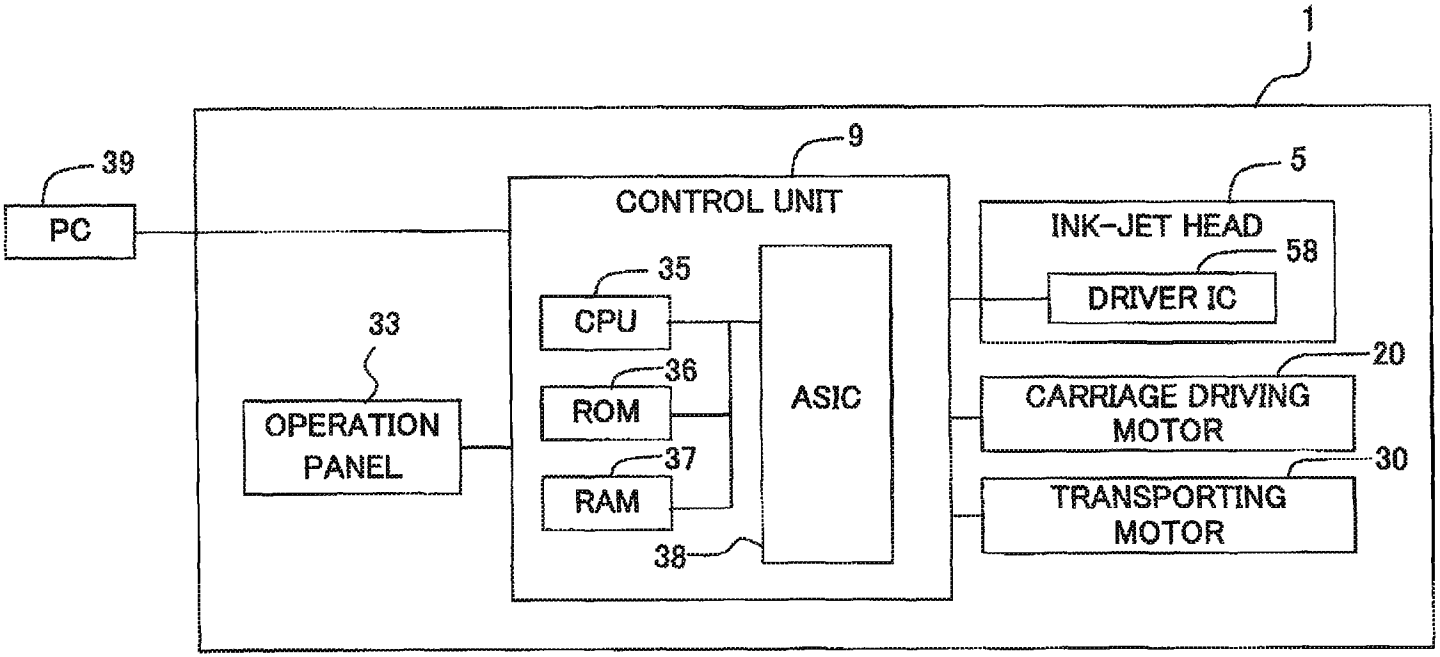
FIG. 2 is a block diagram showing schematically an electrical configuration of the printer.

The paper feeding roller 7 and the paper discharge roller 8 are driven to be rotated in synchronization by the transporting motor 30 (refer to FIG. 2). The paper feeding roller 7 and the paper discharge roller 8 cooperate to transport the recording paper 100 placed on the platen 2 in the transporting direction shown in FIG. 1.

The control unit 9 shown in FIG. 2 includes a CPU (central processing unit) 35, a ROM (read only memory) 36, a RAM (random access memory) 37, and an ASIC (application specific integrated circuit) 38 which includes various control circuits. As shown in FIG. 2, the control unit 9 is connected to various units constituting the printer 1, such as the ink-jet head 5 and a transporting motor 30. Moreover, the control unit 9 is also connected to an operation panel 33 and a PC (personal computer) 39 which is an external device.

The control unit 9, in accordance with a computer program stored in the ROM 36, executes the following print processing by the CPU 35 and the ASIC 38. In other words, the control unit 9 controls the ink-jet head 5, the carriage drive motor 20, and the transporting motor 30 based on a print command that has been transmitted from the PC 39, to print an image and characters etc. on the recording paper 100. More elaborately, the control unit 9 controls the ink-jet head 5, the carriage drive motor 20, and the transporting motor 30 to jet inks, onto the recording paper 100 placed on the platen 2, in a predetermined liquid jetting direction (direction of gravitation force in the present embodiment) from the plurality of nozzles of the ink-jet head 5, while making the carriage 3 move in the scanning direction. Moreover, the recording paper 100 is transported by a predetermined amount in the transporting direction by the paper feeding roller 7 and the paper discharge roller 8. By carrying out an ink jetting operation of the ink-jet head 5 and a transporting operation of the paper feeding roller 7 and the paper discharge roller 8 as described above alternately and repeatedly, an image and characters etc. are printed on the recording paper 100. In the abovementioned description, the control unit 9 has been described as a unit that includes a CPU, a ROM, a RAM, and an ASIC. However, the present invention is not restricted to such control unit, and the control unit 9 may be realized by any hardware configuration. For instance, the control unit 9 may be realized by dividing the functions among two or more CPUs and two or more ASICs.

<Detailed Structure of Ink-Jet Head>

Figure 4:
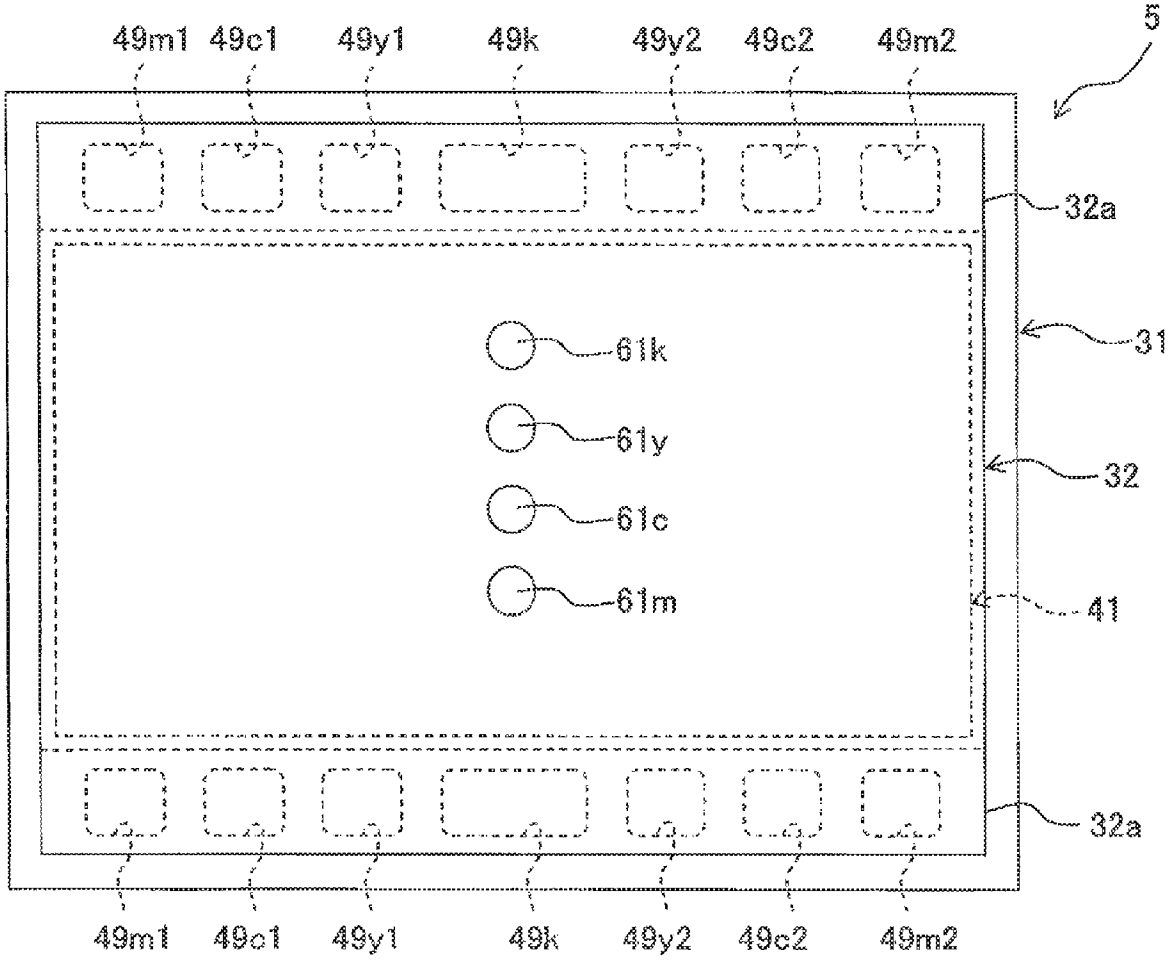
FIG. 4 is a top view of the ink-jet head.

Next, details of the ink-jet head 5 will be described below. As it has already been mentioned, the ink-jet head 5 includes the ink jetting section 31 and the ink supply section 32 as shown in FIG. 3 and FIG. 4.

As shown in FIG. 3, the ink jetting section 31 has, on a lower surface thereof, the ink jetting surface 31*a* in which the plurality of nozzles 47 are arranged. The ink supply section 32 is disposed on the ink jetting section 31 on a side (upper side) opposite to the ink jetting surface 31*a* in a direction intersecting the ink jetting surface 31*a* (an ink jetting direction from the nozzles 47). Moreover, both the ink jetting section 31 and the ink supply section 32 have rectangular planar shapes, respectively. Furthermore, a size of the ink supply section 32 when viewed from the top, or in other words, a size in a plane parallel to the ink jetting surface 31*a* is same as or smaller than the ink jetting section 31. Particularly, in FIG. 4, the ink supply section 32 is shown to be slightly smaller than the ink jetting surface 31*a*, and when viewed from the top, the ink supply section 32 is accommodated in a range within an outer edge of the ink jetting section 31.

<Ink Jetting Section>

Figure 5:
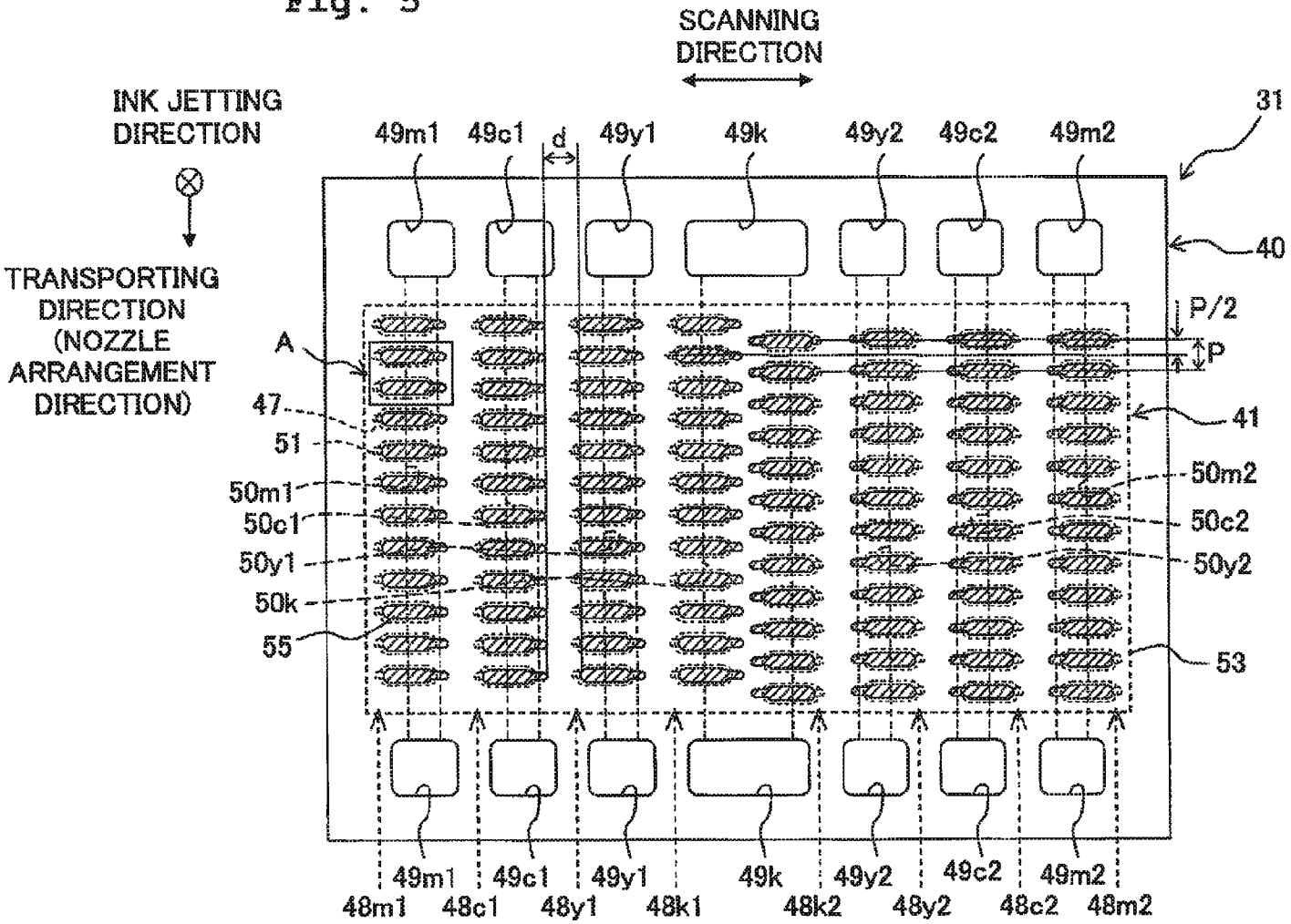
FIG. 5 is a top view of an ink jetting section.
Figure 6A:
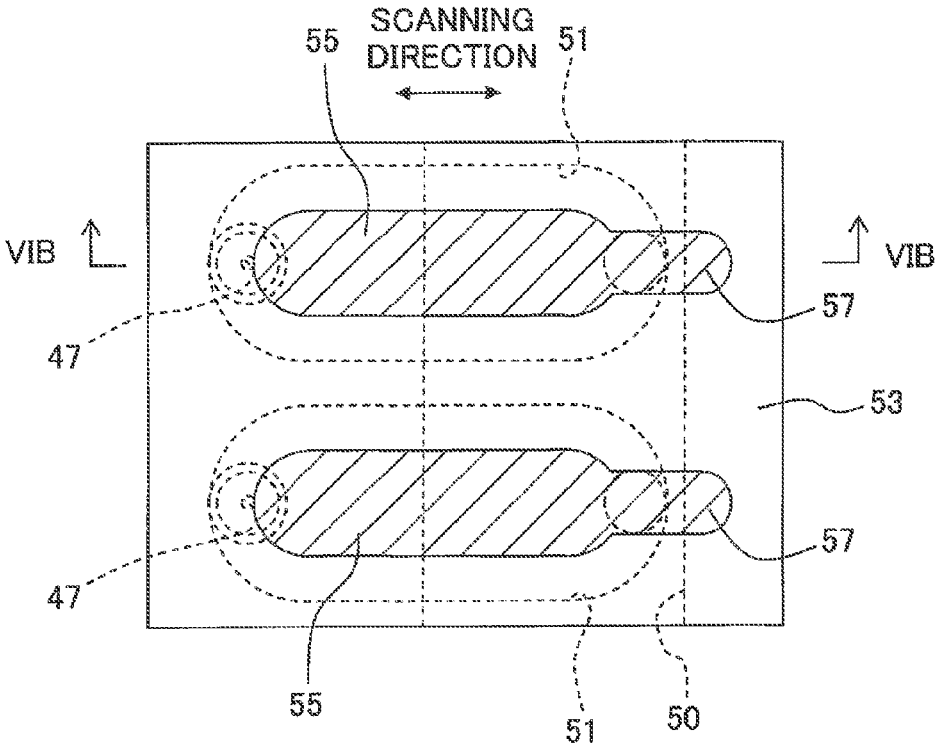
FIG. 6A is an enlarged view of a portion A in FIG. 5.
Figure 6B:
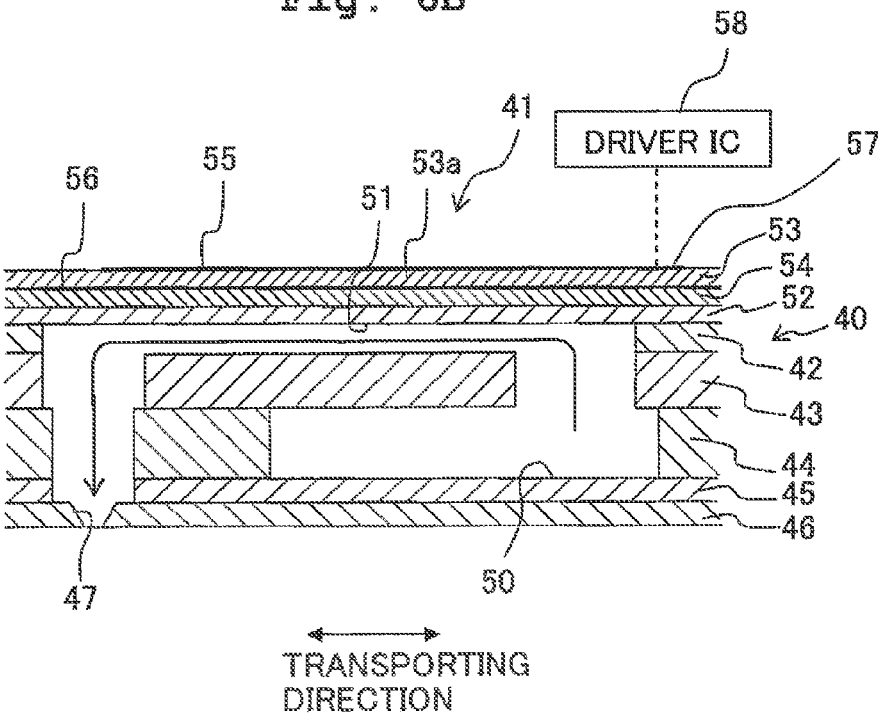
FIG. 6B is a cross-sectional view along a line VIB-VIB in FIG. 6A.

Firstly, the ink jetting section 31 will be described below. As shown in FIG. 5 to FIG. 6B, the ink jetting section 31 includes a channel unit 40 and a piezoelectric actuator 41.

As shown in FIG. 6B, the channel unit 40 has a structure in which five plates 42, 43, 44, 45, and 46 (hereinafter, "five plates 42 to 46") are stacked. The lowermost plate 46 out of the five plates 42 to 46 is a nozzle plate in which the plurality of nozzles 47 are formed. In other words, a lower surface of the nozzle plate 46 forms the ink jetting surface 31*a*. Whereas, channels such as pressure chambers 51 and manifolds 50 which communicate with the plurality of nozzles 47 are formed in the remaining four plates 42, 43, 44, and 45 on the upper side.

An arrangement of the plurality of nozzles 47 formed in the nozzle plate 46 will be described below by referring to FIG. 5. The plurality of nozzles 47 are aligned in the transporting direction at a pitch P in the nozzle plate 46. The plurality of nozzles 47 forms a total of eight nozzle groups 48 arranged in the scanning direction. In the present embodiment, the arrangement direction of the plurality of nozzles (nozzle arrangement direction) is orthogonal to the scanning direction. However, the arrangement of the plurality of nozzles 47 is not restricted to such an arrangement, and the nozzle arrangement direction may intersect with the scanning direction at an angle other than 90 degrees.

The eight nozzle groups 48 include two nozzle groups 48*k*1 and 48*k*2 which jet a black ink, two nozzle groups 48*y*1 and 48*y*2 which jet a yellow ink, two nozzle groups 48*c*1 and 48*c*2 which jet a cyan ink, and two nozzle groups 48*m*1 and 48*m*2 which jet a magenta ink. Each of the nozzle groups 48 may have length in the nozzle arrangement direction which is not less than 1 inch and not more than 1.5 inch. In the following description, for components corresponding to the black ink (K), the yellow ink (Y), the cyan ink (C), and the magenta ink (M), one of the characters "k" indicating black, "y" indicating yellow, "c" indicating cyan, and "m" indicating magenta is assigned appropriately to understand as to which color of ink the component corresponds to. Between the two nozzle groups 48 jetting an ink of the same color (such as the two nozzle groups 48*k*1 and 48*k*2), positions of the nozzles 47 in the nozzle arrangement direction are shifted by half of the pitch P (P/2) for each nozzle group 48.

The two nozzle groups 48*k*1 and 48*k*2 for the black ink are arranged to be adjacent at a center in the scanning direction. The two nozzles groups 48*y*1 and 48*y*2 for the yellow ink are arranged outside the two nozzle groups 48*k*1 and 48*k*2 for the black ink in the scanning direction, sandwiching the two nozzles groups 48*k*1 and 48*k*2. The two nozzle groups 48*c*1 and 48*c*2 for the cyan ink are arranged outside the two nozzle groups 48*y*1 and 48*y*2 in the scanning direction, and the two nozzle groups 48*m*1 and 48*m*2 for the magenta color are arranged further outside the two nozzle groups 48*c*1 and 48*c*2 in the scanning direction. In other words, an arrangement of the nozzle groups 48 for the inks of four colors black, yellow, cyan, and magenta is bilaterally symmetric. Accordingly, in a so-called bidirectional printing, at the time of moving the ink-jet head 5 toward one side in the scanning direction and at the time of moving the ink-jet head 5 toward the other side in the scanning direction, by using the four nozzle groups on the left side and the right side properly, it is possible to form a dot by making the inks of four colors land on the recording paper 100 in the same order (in other words, an order of magenta, cyan, yellow, and black) all the time. In other words, by the nozzle arrangement in the ink jetting section 31 of the present embodiment, it is possible to record an image etc. with a high quality by letting a color order of each dot to be same, while adopting the bidirectional printing for high speed recording.

An arrangement of the nozzle groups 48*m*, 48*c*, and 48*y* for the inks of three colors arranged on the left side and the right side sandwiching the nozzle groups 48*k* for the ink of black color is not restricted to such arrangement, and can be changed appropriately. For instance, the nozzle groups 48*m*, 48*c*, and 48*y* of three colors in order of magenta, cyan and yellow from left may be arranged on the left side and the right side of the nozzle groups 48*k* for the black ink. Moreover, as aforementioned, in FIG. 5, a configuration, in which the positions of the nozzles 47 in the nozzle arrangement direction are shifted between the two nozzle groups 48 of each color (for example, between the nozzle group 48*k*1 and the nozzle group 48*k*2 for the ink of black color), is shown. However the positions of the nozzles 47 may coincide between the two nozzle groups 48 for the ink of each color.

Next, a structure of the ink channels which are formed in the four plates 42 to 46 on the upper side of the channel unit 40 and which communicate with the plurality of nozzles 47 will be described below. Firstly, as shown in FIG. 5, seven ink supply holes 49 aligned in the scanning direction are formed, on an upper surface of the channel unit 40, at each of an upstream-side end portion and a downstream-side end portion in the transporting direction (i.e. total of 14 ink supply holes 49). The inks are supplied to the ink supply holes 49 from the ink supply section 32 that will be described later. A size of an ink supply hole 49*k* positioned at the center out of the seven ink supply holes 49 aligned in the scanning direction is larger than a size of each of the other six ink supply holes 49.

Moreover, seven manifolds 50 (common liquid chambers of the present invention) extending in the transporting direction (nozzle arrangement direction) respectively are formed in the channel unit 40. Two end portions of each manifold 50 are connected to the two ink supply holes 49 respectively. The black ink is supplied to the manifold 50*k* through the ink supply holes 49*k*. The yellow ink is supplied to the manifolds 50*y*1 and the manifold 50*y*2 through the ink supply holes 49*y*1 and 49*y*2, respectively. The cyan ink is supplied to the manifolds 50*c*1 and 50*c*2 through the ink supply holes 49*c*1 and 49*c*2, respectively. Furthermore, the magenta ink is supplied to the manifolds 50*m*1 and 50*m*2 through the ink supply holes 49*m*1 and 49*m*2, respectively.

The manifolds 50 for the inks of four colors namely, black, yellow, cyan, and magenta are arranged bilaterally symmetrically, similar to the abovementioned nozzle groups 48 for the inks of four colors. In other words, the manifold 50*k* for the black ink is arranged at the center in the scanning direction. The manifolds 50*y*1 and 50*y*2 for the yellow ink are arranged on both sides of the manifold 50*k* in the scanning direction, sandwiching the manifold 50*k*. The manifolds 50*c*1 and 50*c*2 for the cyan ink are arranged outside the manifolds 50*y*1 and 50*y*2 in the scanning direction, and the manifolds 50*m*1 and 50*m*2 for the magenta color are arranged further outside the manifolds 50*c*1 and 50*c*2 in the scanning direction.

Moreover, the channel unit 40 includes a plurality of pressure chambers 51 corresponding to the plurality of nozzles 47 respectively. The plurality of pressure chambers 51 are formed in the plate 42 positioned at the uppermost layer of the channel unit 40, and are arranged flatly corresponding to the plurality of nozzles 47 respectively. As shown in FIG. 5, the plurality of pressure chambers 51 forms eight pressure chamber rows arranged in the scanning direction to correspond to the eight nozzle rows 48 respectively, at positions above the manifolds 50. The two nozzle groups 48*k*1 and 48*k*2 for the black ink are arranged to be adjacent mutually in the scanning direction, and the corresponding two pressure chamber rows are also arranged to be adjacent each other. Therefore, the two pressure chamber rows for the black ink commonly communicate with one manifold 50*k* positioned directly below the two pressure chamber rows for the black ink. Whereas, each of the pressure chamber rows corresponding to one of the other nozzle groups 48 communicates with one manifold 50 positioned directly below the pressure chamber row. Accordingly, as shown by an arrow in FIG. 6B, a plurality of individual channels branched from each of the manifolds 50 and reaching the nozzles 47 via the pressure chambers 51 are formed in the channel unit 40.

As shown in FIG. 5, the piezoelectric actuator 41 (energy applying unit of the present invention) is joined to an upper surface of the channel unit 40 to cover the plurality of pressure chambers 51. As shown in FIG. 5, FIG. 6A, and FIG. 6B, the piezoelectric actuator 41 includes an ink sealing film 52, two piezoelectric layers 53 and 54, a plurality of individual electrodes 55, and a common electrode 56.

The ink sealing film 52 is a thin film formed of a material having low ink permeability, such as a metallic material like stainless steel. The ink sealing film 52 is joined to the upper surface of the channel unit 40 to cover the plurality of pressure chambers 51.

Each of the two piezoelectric layers 53 and 54 is a ceramics (burned product) which has a form of thin plate and which is formed of a piezoelectric material consisting mainly of lead zirconate titanate which is a mixed crystal of lead titanate and lead zirconate. The piezoelectric layers 53 and 54 are arranged on an upper surface of the ink sealing film 52, in a state of being stacked one on the other.

The plurality of individual electrodes 55 are arranged on an upper surface of the piezoelectric layer 53 which is an upper layer. More elaborately, each individual electrode 55 is arranged, on the upper surface of the piezoelectric layer 53, in an area facing a central portion of one of the pressure chambers 51, as shown in FIG. 5, FIG. 6A, and FIG. 6B. The plurality of individual electrodes 55 are aligned in the transporting direction (nozzle arrangement direction) to correspond to the plurality of pressure chambers 51 respectively, and form eight individual electrode rows in total. An individual terminal 57 is drawn from each of the individual electrodes 55. A wiring member (not shown in the diagram) on which a driver IC 58 is mounted is connected to the plurality of individual terminals 57. Accordingly, the plurality of individual electrodes 55 are connected to the driver IC 58 electrically. One of a predetermined driving electric potential and a ground electric potential is applied selectively to each of the individual electrodes 55. The distance d (FIG. 5) between two rows of the individual electrodes adjacent to each other in the scanning direction is smaller than width of a connecting channel 60 (described later) in the scanning direction.

The common electrode 56 is arranged between the two piezoelectric layers 53 and 54. The common electrode 56 is facing commonly the plurality of individual electrodes 55, sandwiching the piezoelectric layer 53 therebetween. Although, the concrete structure of electrical connections is omitted, a connecting terminal is also drawn from the common electrode 56 on the upper surface of the piezoelectric layer 53, and is connected to the wiring member not shown in the diagram, similar to the plurality of individual electrodes 55. The common electrode 56 is connected to a ground wire formed on the wiring member and an electric potential of the common electrode 56 is maintained to the ground electric potential all the time.

Portions, of the piezoelectric layer 53, sandwiched between the plurality of individual electrodes 55 and the common electrode 56 (called as active portions 53*a*) are polarized in a thickness direction (downward direction) thereof. The active portions 53*a* are subjected to piezoelectric deformation (piezoelectric distortion) when an electric field acts in the thickness direction thereof due to an electric potential difference generated between the individual electrodes 55 and the common electrode 56.

An operation of the piezoelectric actuator 41 will be described below. As a driving electric potential is applied to a certain individual electrode 55 from the driver IC 58, an electric potential difference is generated between the individual electrode 55 and the common electrode 56. At this time, an electric field acts in the thickness direction (downward direction) of the active portion 53*a* of the piezoelectric layer 53, and a direction of the electric field coincides with a direction in which the active portion 53*a* has polarized. Therefore, the active portion 53*a* contracts in a planar direction, and with the contraction of the active portion 53*a*, a bend which becomes a projection toward the pressure chamber 51 is developed in the two piezoelectric layers 53 and 54. Accordingly, there is a change in a volume of the pressure chamber 51, and a pressure wave is generated in an individual channel including the pressure chamber 51. A jetting energy is imparted to the ink, and droplets of ink are jetted from the nozzle 47.

<Ink Supply Section>

Figure 8A:
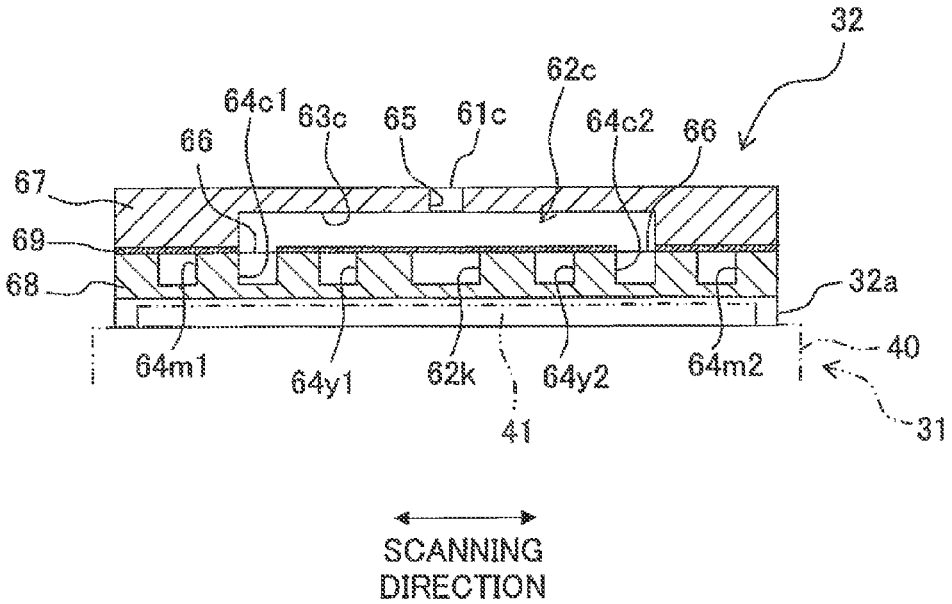
FIG. 8A is a cross-sectional view along a line VIIIA-VIIIA in FIG. 7.
Figure 8B:
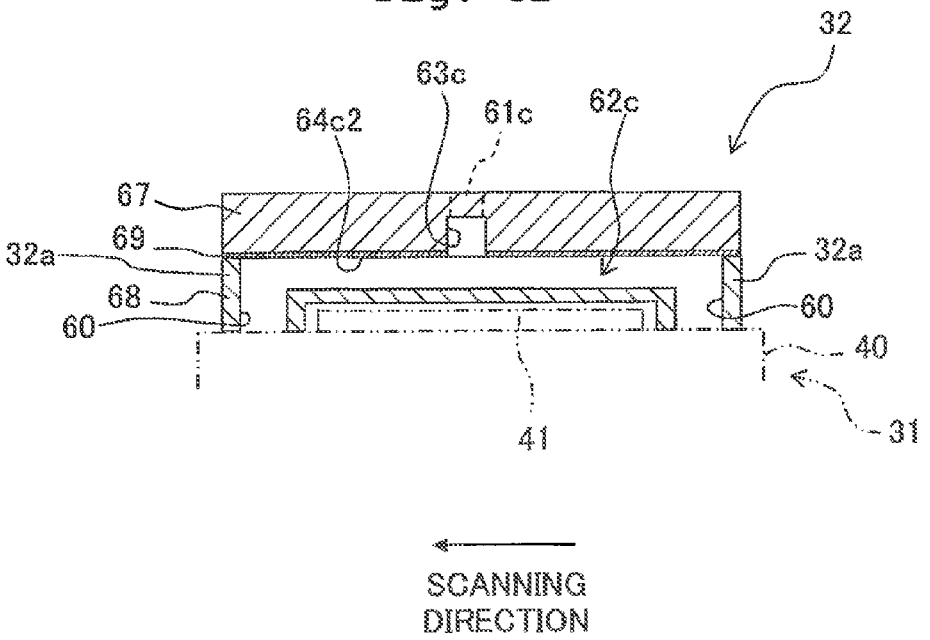
FIG. 8B is a cross-sectional view along a line VIIIB-VIIIB in FIG. 7.

Next, the ink supply section 32 will be described below. As shown in FIG. 3, FIG. 8A, and FIG. 8B, the ink supply section 32 has two connecting portions 32*a* protruding downward (toward the ink jetting section 31), at an upstream-side end portion and a downstream-side end portion in the transporting direction. The ink supply section 32 is connected to the ink supply holes 49 of the ink jetting section 31 via connecting channels 60 formed inside the two connecting portions 32*a*. As shown in FIG. 3 and FIG. 8B, due to the two connecting portions 32*a*, a space is formed between the ink jetting section 31 and the ink supply section 32. The piezoelectric actuator 41 (energy applying unit of the present invention) arranged on the ink jetting section 31 on the side opposite to the ink jetting surface 31*a* is accommodated in the space described above. Accordingly, the piezoelectric actuator 41 of the ink jetting section 31 is protected by the ink supply section 32.

As shown in FIG. 3, FIG. 4, FIG. 7, FIG. 8A, and FIG. 8B, the ink supply section 32 includes four ink inflow portions 61 and four supply channels 62. The four ink inflow portions 61 (61*k*, 61*y*, 61*c*, and 61*m*) are arranged in the nozzle arrangement direction, at a central portion in the scanning direction of the ink supply section 32. As shown in FIG. 3, each of the four ink inflow portions 61 is connected to one of the four connecting channels 28 of the sub tank 4 via the connecting member 29. The connecting member 29 is a member in which channels connecting the four connecting channels 28 aligned in the scanning direction and the four ink inflow portions 61 aligned in the nozzle arrangement direction respectively are formed. The inks of four colors flow into the four ink inflow portions 61 respectively from the sub tank 4.

Figure 7:
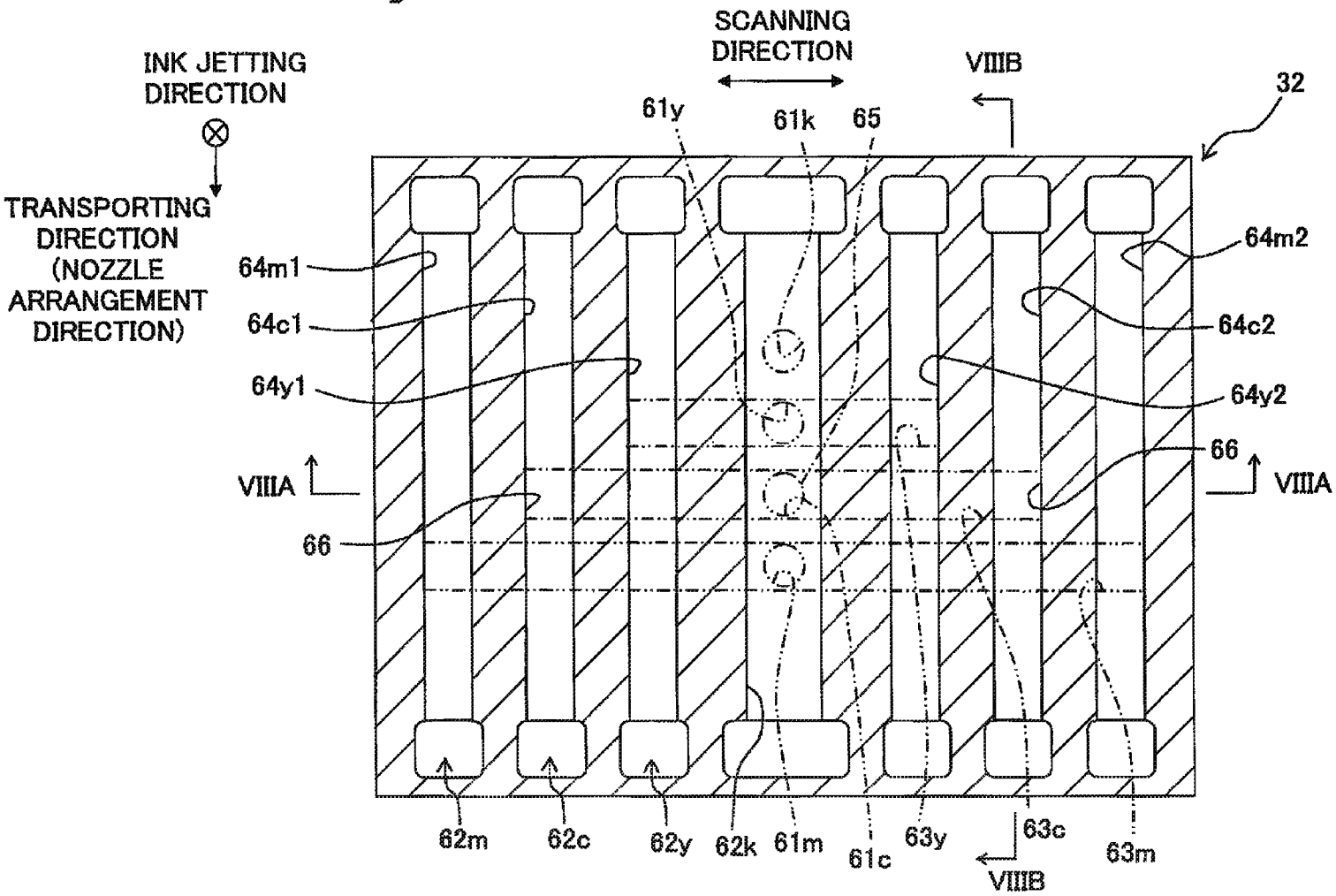
FIG. 7 is a horizontal cross-sectional view of an ink supply section.

The four supply channel 62 (62*k*, 62*y*, 62*c*, and 62*m*) connect the ink inflow portions 61 for the inks of four colors and the manifolds 50 (refer to FIG. 5) for the inks of four colors of the aforementioned ink jetting section 31, respectively. As shown in FIG. 7, the ink inflow portion 61*k* for the black ink is arranged at a position directly above a central portion of the manifold 50*k* for the black ink. Moreover, the supply channel 62*k* for the black ink extends from the ink inflow portion 61*k* to both sides in the nozzle arrangement direction. Furthermore, the supply channel 62*k* is connected to the manifold 50*k* for the black ink, via the two connecting channels 60 formed in the two connecting portions 32*a* of the ink supply section 32, at the two ink supply holes 49*k*.

Each of the supply channels 62 (62*y*, 62*c*, and 62*m*) for the other three colors has a stereoscopic branched-channel structure for distributing the ink of same color to the two manifolds 50 which are arranged to sandwich the manifold 50*k* for the black color in the scanning direction. In other words, each of the supply channels 62*y*, 62*c*, and 62*m* has an upstream-side channel 63 connected to one of the ink inflow portions 61 and two downstream-side channels 64 connecting the upstream-side channel 62 and the two manifolds 50 respectively. FIG. 8A and FIG. 8B are cross-sectional views of the supply channel 62*c* for the cyan ink in FIG. 7. As shown in FIG. 8A and FIG. 8B, the upstream-side channel 63 is arranged on a side opposite to the ink jetting section 31 in the ink jetting direction, with respect to the downstream-side channels 64. Namely, the upstream-side channel 63 is arranged above the downstream-side channels 64. In the present embodiment, out of the supply channels 62 for the inks of four colors, the supply channels other than the supply channel 62*k* for the black ink, or in other words, the three supply channels 62*y*, 62*c*, and 62*m* correspond to the "supply channel" of the present invention, having the upstream-side channel 63 and the downstream-side channels 64.

The ink supply section 32, more elaborately, has two channels members 67 and 68 made of resin moldings and joined to each other as shown in FIG. 8A and FIG. 8B. The upstream-side channels 63 are formed in the channel member 67, and before joining, the upstream-side channels 63 are open downward. The downstream-side channels 64 are formed in the channel member 68, and before joining, the downstream-side channels 64 are open upward. A sealing film 69 made of a material such as a resin film is stuck between the two channel members 67 and 68. However, since the sealing film 69 has not been stuck locally on second connecting portions 66 of the upstream-side channels 63 and the downstream-side channels 64, each of the upstream-side channels 63 communicates with two of the corresponding downstream-side channels 64, and the ink is capable of flowing from each of the upstream-side channels 63 to the two of the corresponding downstream-side channels 64.

Each of the upstream-side channel 63 is arranged directly below the corresponding ink inflow portion 61, and is connected to the corresponding ink inflow portion 61. A portion connecting each of the upstream-side channels 63 and one of the ink inflow portions 61 is called as a "first connecting portion 65". Each of the upstream-side channels 63 is extended from the first connecting portion 65 toward both sides in the scanning direction, and is connected to the two downstream-side channels 64. Portions connecting each of the upstream-side channels 63 and the two of corresponding downstream-side channels 64 are called as "second connecting portions 66". The two downstream-side channels 64 are arranged to sandwich the ink inflow portion 61 therebetween, and are arranged apart from each other in the scanning direction. In other words, the two second connecting portions 66 are arranged apart from the first connecting portion 65 in the scanning direction, and the upstream-side channel 63 connects the first connecting portion 65 and the two second connecting portions 66. Moreover, the second connecting portions 66 are positioned at central portions in a longitudinal direction of the downstream-side channels 64 (i.e. nozzle arrangement direction).

The two downstream-side channels 64 are extended in the nozzle arrangement direction respectively, at a position directly above the two corresponding manifolds 50 (refer to FIG. 5) of the ink jetting section 31. Each downstream-side channel 64, similar to the aforementioned supply channel 62*k* for the black ink, is connected to the corresponding manifold 50 at the two ink supply holes 49, via the two connecting channels 60 formed in the two connecting portions 32*a* of the in supply section 32 respectively. In other words, each downstream-side channel 64 is connected to the corresponding manifold 50 at both end portions in the nozzle arrangement direction via the two connecting channels 60 and the two ink supply holes 49. In the embodiment, since each downstream-side channel 64 is connected to the corresponding manifold 50 only at both end portions in the nozzle arrangement direction and is not connected to the corresponding manifold 50 at any portion on a center side in the nozzle arrangement direction, there is no need to form any connecting channel 60 nor ink supply hole 49. Thus, there is no need to form a hole at any portion, on the center side in the nozzle arrangement direction, of the piezoelectric actuator 41 arranged between the two connecting channels 60, and it is possible to suppress the size of the piezoelectric actuator 41 in the transporting direction.

As shown in FIG. 7 and FIG. 8A, each upstream-side channel 63 is disposed across the downstream-side channels 64 for the ink of another color (and the supply channel 62 for the black ink) which are positioned at an inner side of the two corresponding downstream-side channels 64. In other words, the upstream-side channel 63*y* for the yellow ink extends across the supply channel 62*k* for the black ink. Moreover, the upstream-side channel 63*c* for the cyan ink extends across the supply channel 62*k* for the black ink and the two downstream-side channels 64*y*1 and 64*y*2 for the yellow ink. Furthermore, the upstream-side channel 63*m* for the magenta ink extends across the supply channel 62*k* for the black ink, the two downstream-side channels 64*y*1 and 64*y*2 for the yellow ink, and the two downstream-side channels 64*c*1 and 64*c*2 for the cyan ink. Accordingly, the upstream-side channels 63 and the downstream-side channels 64 of the respective supply channels 62 intersect stereoscopically, and a channel structure of the supply channels 62 becomes compact.

In the ink supply section 32 as described above, the black ink flowed into the ink inflow portion 61*k* is distributed in the nozzle arrangement direction by the supply channel 62*k*, and is supplied to the two ink supply holes 49*k* of the ink jetting section 31.

Moreover, flow of the ink in each of the supply channels 62*y*, 62*c*, and 62*m* for the yellow ink, the cyan ink, and the magenta ink is as described below. The ink that has flowed into one ink inflow portion 61 flows from the first connecting portion 65 into the upstream-side channel 63, and is distributed in the scanning direction from the first connecting portion 65 toward the two second connecting portions 66 by the upstream-side channel 63, and is supplied from the two second connecting portions 66 to the two downstream-side channels 64 respectively. Moreover, each downstream-side channel 64 is connected to the one manifold 50 extending in the nozzle arrangement direction at the two ink supply holes 49. Consequently, the ink that has flowed from the second connecting portion 66 to each downstream-side channel 64 is distributed in the nozzle arrangement direction by the downstream-side channel 64, and is supplied to the one manifold 50 from two locations.

In the present embodiment described above, the ink supply section 32 is disposed on the ink jetting section 31 on the side opposite to the ink jetting surface 31*a*, and the supply channels 62 (62*y*, 62*c*, and 62*m*) each having a stereoscopic branched structure in which the upstream-side channel 63 positioned above the two downstream-side channels 64 intersects with the two downstream-side channels 64 positioned below the upstream-side channel 63, is formed in the ink supply section 32. Accordingly, the channel structures inside the ink supply section 32 become compact, and miniaturization of the ink supply section 32 becomes possible. In other words, by providing a channel for distributing the ink to the two manifolds 50, a planar size of the ink-jet head 5 is suppressed from becoming large.

Moreover, in the present embodiment, the ink is supplied from each downstream-side channel 64 to the corresponding manifold 50 via the two ink supply holes 49. Therefore, even in a case in which an amount of consumption of ink in each nozzle group 48 is large, it is possible to supply the ink promptly from the downstream-side channel 64 to the manifold 50.

Moreover, in the present embodiment, a method has been devised so that a channel resistance for each of the upstream-side channels 63 and the downstream-side channels 64 becomes as small as possible. Concretely, each of the upstream-side channels 63 extends along the scanning direction. In other words, since each of the upstream-side channel 63 extends to connect linearly the two second connecting portions 66 arranged apart in the scanning direction, the channel resistance in each of the upstream-side channels 63 is suppressed to be small. Moreover, each of the two downstream-side channels 64 extends in the nozzle arrangement direction. In other words, since each of the downstream-side channel 64 extends parallel to the manifold 50 to connect the two ink supply holes 49 linearly, the channel resistance in each of the downstream-side channel 64 is suppressed to be small.

Moreover, in the present embodiment, since the two connecting portions 66 which connect the upstream-side channel 63 and the downstream-side channels 64 are positioned at central portions of the downstream-side channels 64 respectively, it is possible to make a difference in an amount of supply of ink (ease of supplying the ink) small between two end portions in the nozzle arrangement direction of each downstream-side channel 64. In other words, ease of supplying the ink is not so different between the pressure chambers positioned at two end sides of each manifold.

In the present embodiment, as shown in FIG. 1, the ink cartridges 25 are provided separately from the carriage 3, and the carriage 3 (the ink-jet head 5) and the ink cartridges 25 are connected by the tubes 24. As compared with a so-called on-carriage arrangement in which the ink cartridges 25 are mounted on the carriage 3, in this arrangement, there is no large member such as the ink cartridge 25 mounted on the carriage 3. Therefore, the large-sizing of the ink supply section 32 is susceptible to cause a large-sizing of the overall ink jet-jet head 5 (carriage 3). In other words, the present invention can be said to be particularly effective with an arrangement in which the ink cartridges 25 are arranged apart from the ink-jet head 5 and connected by the tubes 24.

Next, modified embodiments in which various modifications are made in the embodiment will be described below. However, same reference numerals are assigned to components similar to the components in the embodiment, and description of such components is omitted.

In the embodiment, the upstream-side channel 63 extends linearly along the scanning direction, and the downstream-side channels 64 also extend linearly along the nozzle arrangement direction. However, a channel shape of at least one of the upstream-side channel 63 and the downstream-side channels 64 may be changed as follows. For instance, the upstream-side channel 63 may extend in a direction inclined with respect to the scanning direction. Or, the downstream-side channel 64 may extend in a direction inclined with respect to the nozzle arrangement direction. Moreover, the upstream-side channel 63 and the downstream-side channel 64 may be channels in curved forms, or may be channels that are bent.

In the supply channel 62 of which downstream-side channels 64 are positioned outside in the scanning direction, as compared with the supply channel 62 of which downstream-side channels 64 are positioned inside, a length of the upstream-side channel 63 extending along the scanning direction becomes longer, and there is a difference in the channel resistance of the two supply channels 62. Therefore, the shapes of the upstream-side channels 63 may be different from each other so that the difference in the channel resistance becomes small. For instance, a length of the upstream-side channel 63 and a length of the downstream-side channels 64 may be adjusted such that a total length from the ink inflow portion 61 up to each of the ink supply holes 49 becomes same between the supply channels 62.

Figure 9:
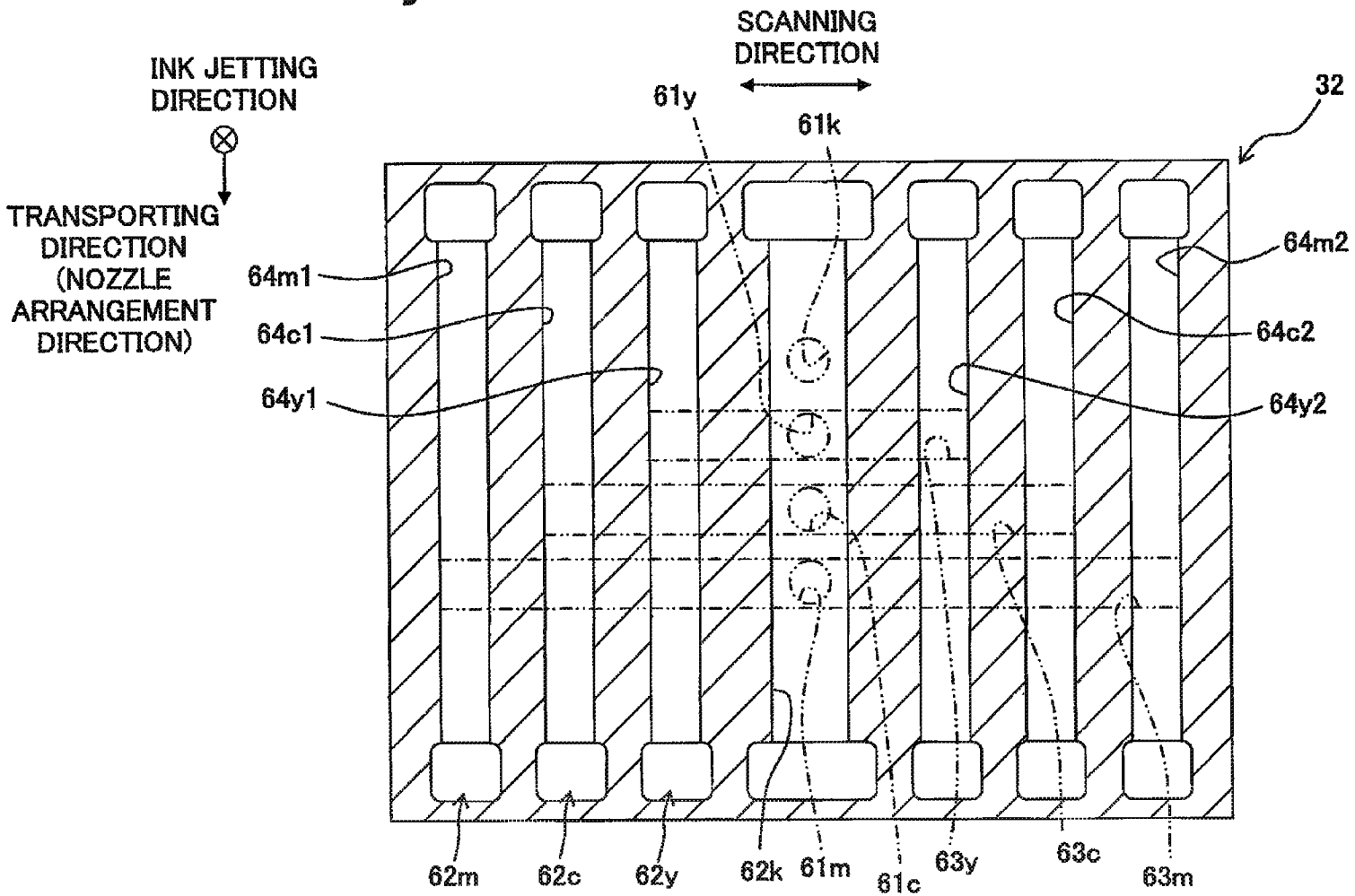
FIG. 9 is a horizontal cross-sectional view of an ink supply section according to a modified embodiment.

Moreover, out of the three supply channels 62*y*, 62*c*, and 62*m*, as the downstream-side channels 64 thereof are positioned at outer side, channel cross-sectional areas of corresponding upstream-side channels 63 may become larger. For instance, in FIG. 9, a channel width of the upstream-side channel 63*m* for the magenta ink is the largest, and subsequently, the channel width of the upstream-side channel 63*c* for the cyan ink is the second largest, and the channel width of the upstream-side channel 63*y* for the yellow ink is the smallest. Moreover, a channel height (depth) of the upstream-side channels 63 may be different. Moreover, conversely, an arrangement may be made such that, as the downstream-side channel 64 thereof are positioned at inner side, channel resistances per unit lengths of the upstream-side channels 63 may become greater. For instance, by letting the upstream-side channel 63 have a bent channel shape or a curved channel shape, it is possible to make the channel resistance greater as compared with a linear channel shape.

Moreover, regarding the difference in the lengths of the upstream-side channels 63 for the supply channels 62, the difference in the channel resistances in the overall supply channels 62 may be made small by letting the channel shapes of the downstream-side channels 64 differ.

Figure 10:
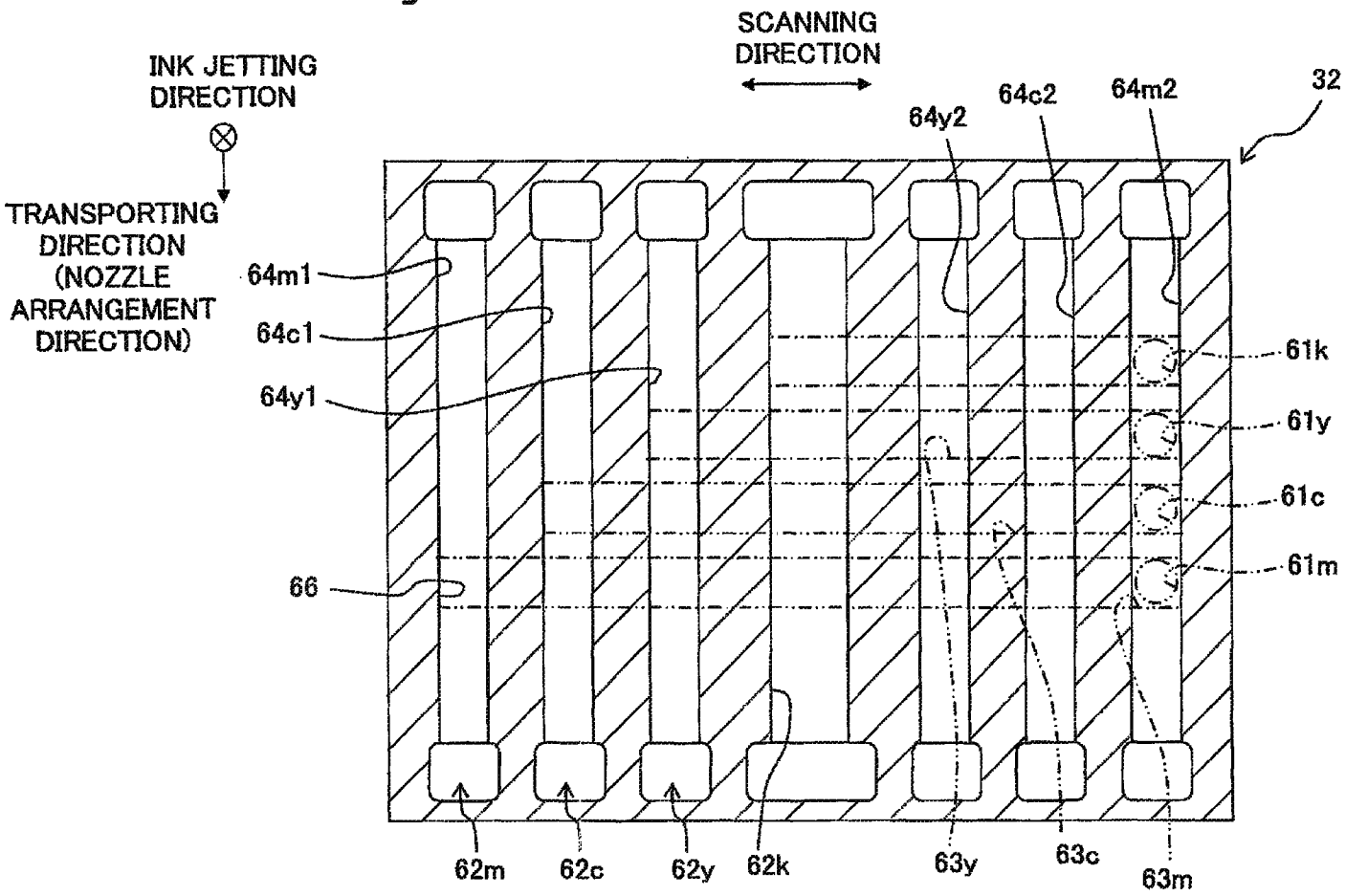
FIG. 10 is a horizontal cross-sectional view of an ink supply section according to another modified embodiment.
Figure 11:
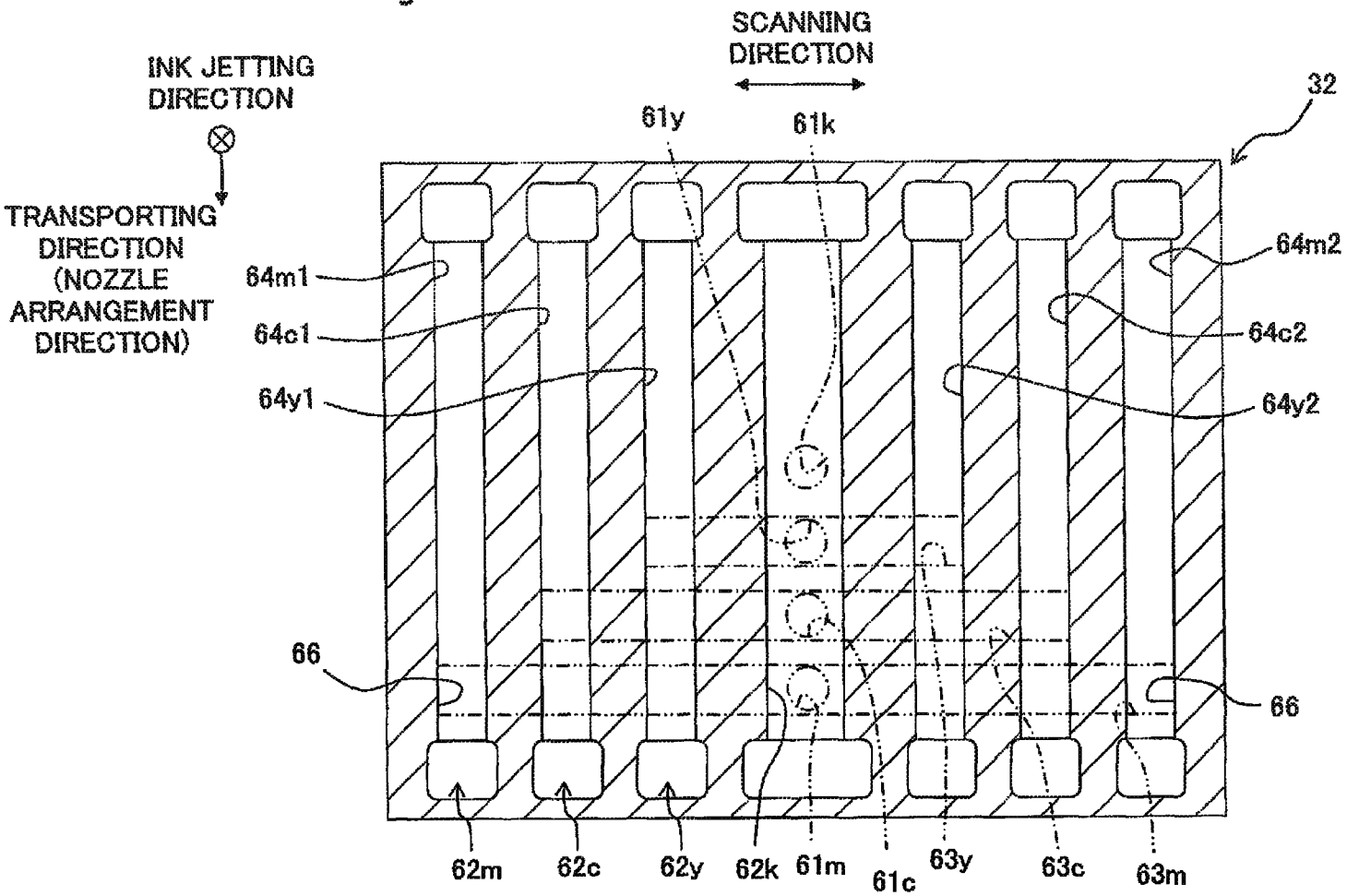
FIG. 11 is a horizontal cross-sectional view of an ink supply section according to still another modified embodiment.

Positions of the ink inflow portions 61, the first connecting portions 65, and the second connecting portions 66 are not restricted to the positions in the embodiment. For instance, as shown in FIG. 10, the ink inflow portions 61 and the first connecting portions 65 which connect the ink inflow portions 61 and the upstream-side channels 63 may be provided to end portions on one side in the scanning direction of the ink supply section 32. Moreover, in the embodiment, the second connecting portions 66, which connects the upstream-side channels 63 and the downstream-side channels 64, are positioned at the central portions of the downstream-side channels 64. However, as shown in FIG. 11, at least for a part of the supply channels 62 (here, the supply channel 62*m* for the magenta ink), the two second connecting portions 66 may be positioned at end portions of the downstream-side channels 64.

In the embodiment, the ink is supplied to a nozzle group aligned in one row from one manifold 50 as shown in FIG. 5. In other words, one nozzle group 48 is formed by one nozzle row. However, the ink may be supplied to two nozzle rows from one manifold 50. In this mode, one nozzle group 48 is formed by two nozzle rows.

In the embodiment, ink-jet head 5 has the plurality of nozzle groups 48 for jetting the inks of four colors respectively; and the two nozzle groups 48 for jetting the ink of same color have been arranged to sandwich the nozzle group 48 for jetting the ink of another color in the scanning direction. However, the present invention is also applicable to an ink-jet head which jets an ink of only one type. In other words, by applying the present invention to an ink-jet head in which two nozzle groups for jetting the one type of ink are arranged apart from each other, it is possible to distribute and supply the ink that has flowed in from one ink inflow portion 61 to the two nozzle groups by the supply channel 62 of the present invention.

An arrangement may be such that the supply channel 62 connected to one ink inflow portion 61 has the upstream-side channel 63 and three or more downstream-side channels 64 connected to the upstream-side channel 63. Moreover, the number of locations at which one downstream-side channel 64 and the corresponding manifold 50 are connected may be three or more than three. In other words, three or more than three ink supply holes 49 may be provided to one manifold 50.

In the embodiment, the plurality of nozzle groups 48 for jetting the inks of four colors respectively and the plurality of manifolds 50 corresponding to the nozzle groups 48 respectively are formed in one ink jetting section 31. However, the present invention is not limited to this arrangement. For example, the ink jetting section may include a plurality of sub ink jetting sections arranged in the scanning direction, and one nozzle group among two nozzle groups for jetting the same kind (color) of ink and a manifold communicating with the one nozzle group may be formed in one sub ink jetting section, and the other nozzle group among the two nozzle groups and a manifold communicating with the other nozzle group may be formed in another sub ink jetting section different from the one sub ink jetting section.

An arrangement may be such that each of the plurality of nozzle groups arranged apart from each other in the scanning direction is divided into two or more than two groups in the nozzle arrangement direction. Moreover, an arrangement may be such that each of the plurality of manifolds arranged apart from each other in the scanning direction is divided into two or more than two manifolds in the nozzle arrangement direction.

An example of a concrete arrangement of this mode will be described below by citing an example of a case in which two ink jetting sections having the same structures are arranged side by side. An ink-jet head 70 in FIG. 12 according to this modified embodiment includes two ink jetting sections 31A and 31B having the same structure and arranged to be mutually symmetrical with respect to a point. The ink supply section 32 has a channel structure (the ink inflow portion 61 and the supply channels 62) similar to the abovementioned embodiment, and the channel structure thereof is not shown in the diagram. However, the ink supply section 32 supplies the ink to the two ink jetting sections 31A and 31B.

Each of the two ink jetting sections 31A and 31B are arranged side by side in the scanning direction, has partial nozzle groups 71 for four colors (total of eight partial nozzle groups 71) and partial manifolds 72 for four colors (total of seven partial manifolds 72). The eight partial nozzle groups 71 of the ink jetting section 31A and the corresponding eight partial nozzle groups 71 of the ink jetting section 31B are aligned in the nozzle arrangement direction. Moreover, the seven partial manifolds 72 of the ink jetting section 31A and the corresponding seven partial manifolds 72 of the ink jetting section 31B are aligned in the nozzle arrangement direction.

Moreover, one downstream-side channel 64 of the ink supply section 32 is connected to the two partial manifolds 72 of the two ink jetting sections 31A and 31B arranged apart from each other in the nozzle arrangement direction at the two ink supply holes 73 of the two ink jetting sections 31A and 31B respectively. In other words, in this modified embodiment, the downstream-side channel 64 is arranged to be spread across the two ink jetting sections 31A and 31B. In other words, the ink is supplied from the one downstream-side channel 64 to the two partial manifolds 72 (two partial nozzle groups 71) at the respective connection points. Namely, in this modified embodiment, one nozzle group of the present invention is formed by two partial nozzle groups 71, of the two ink jetting sections 31A and 31B, aligned in the nozzle arrangement direction. Moreover, one common liquid chamber of the present invention is formed by the two partial manifolds 72, of the two ink jetting sections 31A and 31B, aligned in the nozzle arrangement direction. According to such arrangement, it is possible to arrange channels which distribute inks to the two ink jetting sections 31A and 31B without letting the size to be large.

Figure 12:
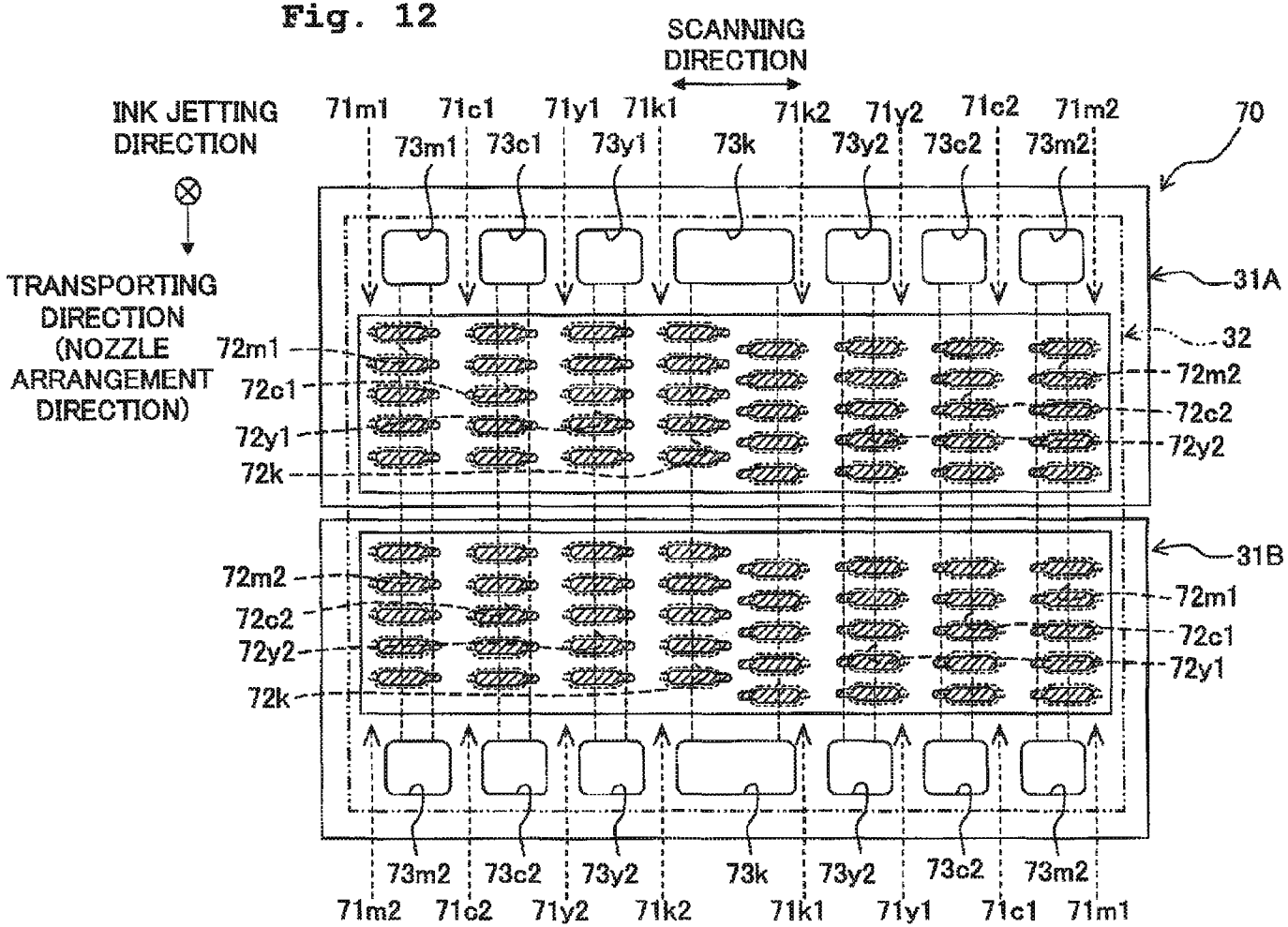
FIG. 12 is a top view of an ink jetting section according to another modified embodiment.

In the arrangement in FIG. 12, only one ink supply hole 73 is provided to the partial manifold 72 of one ink jetting section 31A (31B). However, two or more than two ink supply holes 73 may be provided to one partial manifold 72. In other words, one downstream-side channel 64 of the ink supply section 32 may be connected to the partial manifold 72 of the one ink jetting section 31A (31B) at two or more than two locations.

In the embodiment and the modified embodiments described heretofore, the present invention is applied to an ink-jet head which prints an image etc. by jetting inks onto a recording paper. However, the present invention is also applicable to a liquid jetting apparatus which is used for various applications other than printing an image etc. For instance, it is possible to apply the present invention also to a liquid jetting apparatus which forms an electroconductive pattern on a surface of a substrate by jetting (spraying) an electroconductive liquid on a substrate.

What is claimed is:

1. A liquid jetting apparatus comprising:

a liquid jetting section having a liquid jetting surface in which a plurality of nozzles are formed, and configured to jet a liquid from the plurality of nozzles; and a liquid supply section provided on the liquid jetting section on a side opposite to the liquid jetting surface with respect to a direction which intersects the liquid jetting surface, and configured to supply the liquid to the liquid jetting section;

wherein the liquid jetting section includes:

two nozzle groups arranged apart from each other in a predetermined scanning direction, each nozzle group including a plurality of nozzles aligned in a nozzle arrangement direction which intersects the scanning direction; and two common liquid chambers arranged apart from each other in the scanning direction, each common liquid chamber extending in the nozzle arrangement direction and communicating with one of the two nozzle groups;

wherein the liquid supply section includes:

a liquid inflow portion into which the liquid flows; and a supply channel configured to connect the liquid inflow portion and the two common liquid chambers;

wherein the supply channel includes:

an upstream-side channel connected to the liquid inflow portion at a first connecting portion; and two downstream-side channels arranged on a side of the liquid jetting section with respect to the upstream-side channel in the direction which intersects the liquid jetting surface, and configured to connect the upstream-side channel with the two common liquid chambers respectively;

wherein at least one of two second connecting portions, which are configured to connect the upstream-side channel with the two downstream-side channels respectively, is arranged apart from the first connecting portion in the scanning direction;

wherein each of the two downstream-side channels is connected to one of the two common liquid chambers at both end portions thereof in the nozzle arrangement direction; and wherein when viewed from the direction which intersects the liquid jetting surface, each of the two downstream-side channels overlaps with one of the two common liquid chambers.

2. The liquid jetting apparatus according to claim 1;

wherein the liquid jetting section includes two sub liquid jetting sections arranged in the scanning direction;

wherein one of the two sub liquid jetting sections includes one of the two nozzle groups and one of the two common liquid chambers communicating with the one of the two nozzle groups; and wherein the other of the two sub liquid jetting sections includes the other of the two nozzle groups and the other of the two common liquid chambers communicating with the other of the two nozzle groups.

3. The liquid jetting apparatus according to claim 1;

wherein the upstream-side channel extends along the scanning direction.

4. The liquid jetting apparatus according to claim 1;

wherein each of the two downstream-side channels extends in the nozzle arrangement direction.

5. The liquid jetting apparatus according to claim 1;

wherein the liquid includes first liquid and second liquid which is different from the first liquid;

wherein the liquid jetting section includes:

two first nozzle groups arranged apart from each other in the scanning direction, each first nozzle group including at least two nozzles which are aligned in the nozzle arrangement direction and from which the first liquid is jetted;

two second nozzle groups arranged apart from each other in the scanning direction, each second nozzle group including at least two nozzles which are aligned in the nozzle arrangement direction and from which the second liquid is jetted;

two first common liquid chambers arranged apart from each other in the scanning direction, and each extending in the nozzle arrangement direction and communicating with one of the two first nozzle groups; and two second common liquid chambers arranged apart from each other in the scanning direction, and each extending in the nozzle arrangement direction and communicating with one of the two second nozzle groups;

wherein the two first nozzle groups are arranged on both sides of the two second nozzle groups in the scanning direction respectively, to sandwich the two second nozzles groups in the scanning direction;

wherein the two first common liquid chambers are arranged on both sides of the two second common liquid chambers in the scanning direction respectively, to sandwich the two second common liquid chambers in the scanning direction;

wherein the liquid supply section has a first supply channel configured to supply the first liquid to the two first nozzle groups and a second supply channel configured to supply the second liquid to the two second nozzle groups; and wherein the two downstream-side channels of the first supply channel are arranged on both sides, of the two downstream-side channels of the second supply channel, in the scanning direction respectively, to sandwich the two downstream-side channels of the second supply channel in the scanning direction.

6. The liquid jetting apparatus according to claim 5;

wherein a cross-sectional area of the upstream-side channel of the first supply channel is greater than a cross-sectional area of the upstream-side channel of the second supply channel.

7. The liquid jetting apparatus according to claim 5;

wherein the two second connecting portions of the first supply channel are positioned at central portions, of the two downstream-side channels of the first supply channel, in the nozzle arrangement direction, respectively; and wherein the two second connecting portions of the second supply channel are positioned at central portions, of the two downstream-side channels of the second supply channel, in the nozzle arrangement direction, respectively.

8. The liquid jetting apparatus according to claim 5;

wherein the upstream-side channel of the first supply channel extends over the two downstream-side channels of the second supply channel.

9. The liquid jetting apparatus according to claim 1;

wherein the liquid jetting section has an energy applying unit arranged on the side opposite to the liquid jetting surface in the direction which intersects the liquid jetting surface and configured to apply jetting energy to the liquid in the plurality of nozzles respectively;

wherein the liquid supply section has two connecting portions protruding toward the liquid jetting section at both end portions in the nozzle arrangement direction;

wherein each of the two downstream-side channels is connected to both end portions, of one of the two common liquid chambers, in the nozzle arrangement direction via the two connecting portions; and wherein the energy applying unit is accommodated in a space formed between the two connecting portions.

10. The liquid jetting apparatus according to claim 1;

wherein the liquid supply section is connected to a liquid storage container configured to store the liquid, by a tube.

11. The liquid jetting apparatus according to claim 1;

wherein each of the two downstream-side channels is connected to at least two portions, of one of the two common liquid chambers, in the nozzle arrangement direction.

12. The liquid jetting apparatus according to claim 9;

wherein the energy applying unit is accommodated in the space, which is formed between the two connecting portions and formed by a surface of the liquid supply section facing the liquid jetting section and a surface of the liquid jetting section on the side opposite to the liquid jetting surface.

13. The liquid jetting apparatus according to claim 1;

wherein with respect to the nozzle arrangement direction, the liquid inflow portion is positioned between the both end portions of one of the two common liquid chambers and between the both end portions of the other of the two common liquid chambers.

14. The liquid jetting apparatus according to claim 1;

wherein when viewed from the direction which intersects the liquid jetting surface, each of the two second connecting portions overlaps with one of the two common liquid chambers.

15. A liquid jetting apparatus comprising:

a liquid jetting section having a liquid jetting surface in which a plurality of nozzles are formed, and configured to jet a liquid from the plurality of nozzles; and a liquid supply section provided on the liquid jetting section on a side opposite to the liquid jetting surface with respect to a direction which intersects the liquid jetting surface, and configured to supply the liquid to the liquid jetting section;

wherein the liquid jetting section includes:

two nozzle groups arranged apart from each other in a predetermined scanning direction, each nozzle group including a plurality of nozzles aligned in a nozzle arrangement direction which intersects the scanning direction; and two common liquid chambers arranged apart from each other in the scanning direction, each common liquid chamber extending in the nozzle arrangement direction and communicating with one of the two nozzle groups;

wherein the liquid supply section includes:

a liquid inflow portion into which the liquid flows; and a supply channel configured to connect the liquid inflow portion and the two common liquid chambers; and wherein the supply channel is connected to the two common liquid chambers, each of the two common liquid chambers being connected to the supply channel at at least one connecting portion; and wherein, with respect to the nozzle arrangement direction, the liquid inflow portion is positioned between both end portions of one of the two common liquid chambers and between both end portions of the other of the two common liquid chambers.

* * * * *